United States Patent [19]

Arnal

[11] 4,375,114

[45] Mar. 1, 1983

[54] HIGH SPEED WIRE BRUSHES

[76] Inventor: Claude Arnal, 6, rue de Pelleport, 75020 Paris, France

[21] Appl. No.: 152,794

[22] Filed: May 23, 1980

[51] Int. Cl.[3] ..... A46B 1/00

[52] U.S. Cl. ..... 15/21 D; 15/181; 15/198; 15/DIG. 3

[58] Field of Search ..... 15/21 D, 21 E, 179, 15/181, 193, 195, 198, 77, 103

[56] References Cited

U.S. PATENT DOCUMENTS

| | | | |
|---|---|---|---|
| 2,800,677 | 7/1957 | Peterson | 15/77 X |
| 3,071,795 | 1/1963 | Hartz et al. | 15/198 |
| 3,245,102 | 4/1966 | Gallmeyer et al. | 15/77 |
| 3,454,976 | 7/1969 | Kijinski | 15/103 X |
| 4,137,594 | 2/1979 | Arnal et al. | 15/21 D |

*Primary Examiner*—Edward L. Roberts
*Attorney, Agent, or Firm*—Theodore Hafner

[57] ABSTRACT

This invention relates to a brush consisting of a number of disc shaped elements molded into a unit-each disc supporting wire bundles extending from one side to the other through holes substantially larger than the cross-section of the corresponding wire bundle, each disc being impregnated with an elastomer to permit applying power under pressure of the elastomer.

1 Claim, 7 Drawing Figures

HIGH SPEED WIRE BRUSHES

This invention relates to increasing the efficiency of cleaning through wire brushing at very high speeds.

A specific object of the invention is to provide at least the ends of the wires which are made of steel, with a brass coating of monomolecular thickness which in turn is coated with an elastomer coupling the wire to the other wires of the brush and it supporting structure.

Another object of the invention is to provide a cylindrical brush with wires extending radially therefrom, and rotatable about its axis, with the wire ends extending toward the surface to be cleaned but substantially not pressing against said surface except at a rotary speed causing the ends of the wires to be over a section of said surface which is of the order of the thickness of the layer to be removed from said surface during the rotation of said brush.

Still another object of the invention is to suspend the wires of a wire brush on a disc with the wires extending radially therefrom, and elastically coupled to said disc through an elastomer whereby each wire at least at its outer end is provided with an elastomer coating which in turn is coupled to the wire surface by means of brass coating of monomolecular thickness; the wires at their opposite ends being so attached to the supporting disc as to permit the wires radially to extend under control of centrifugal force at predetermined speeds, causing wire ends in contact with the surface to be cleaned, to bend and extend over said surface for a distance which is of the order of the thickness of the layer to be removed from the surface to be cleaned.

A further object of the invention, consists in operating a rotating wire brush at such speed, of the order of 10,000 rpm, as to cause the wire ends, normally in stationary condition, to be bent along the tangential periphery of the surface to be brushed, for a distance which is at least of the order of the surface layer to be brushed off; said wire ends consisting of brass-plated steel coated with an elastomer connected to a number of similar-coated steel wire ends; said steel wires at their other ends being attached to a supporting structure through said elastomer in such a way as to permit the wires under control of the speed imparted to the supporting structure to engage the surface to be brushed.

In a specific embodiment of this part of the invention the elastomer consists of synthetic rubber.

In another embodiment of the invention, the elastomer consists of polyurethane.

In still another embodiment of this invention, in addition to steel wires engaging the surface to be brushed at predetermined high speeds, wires are made of plastic, especially of wires being absorptive of at least part of the layer to be brushed-off.

In a specific modification of this part of the invention, the absorptive plastic wires may consist of polypropylene coated with an elastomer layer coupling the plastic wires with each other as well as with the remaining brush structure.

These and other objects of the invention will be more fully apparent from the drawings annexed herein, in which.

Figure 7:
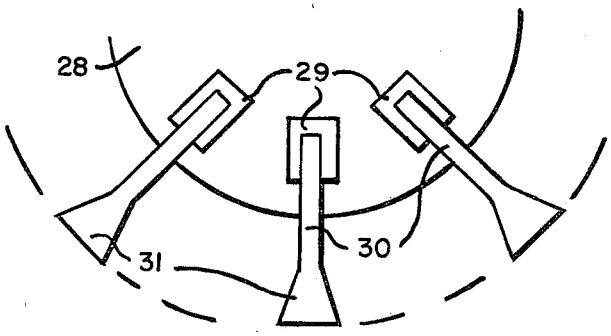

FIG. 7 exemplifies a rotary brush structure comprising wires or wire bundles in schematical form, of different compositions such as wire bundles consisting of steel wires alternatingly arranged with plastic wires.

Figure 1:
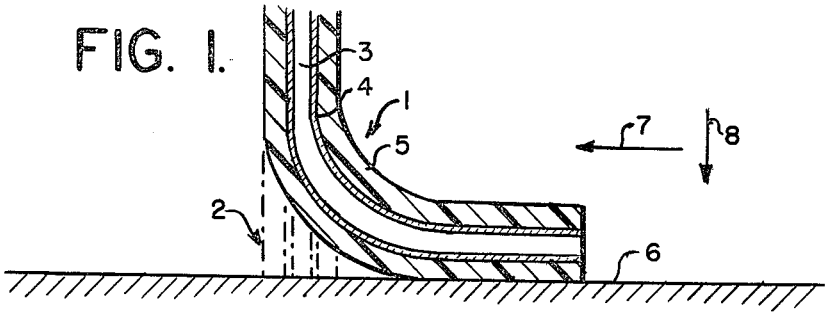
FIG. 1 is a side view, partly in crosssection, represents an individual wire of a rotating wire brush, in operative (and in dotted line, in non-operative) position.

FIG. 1 shows the individual wire of a rotating wire brush, in operative, pressure controlled position (drawn in full line) and in non-operative position (shown in dotted line), at 1, and 2, respectively. The individual wire consists of steel (or equivalent plastic) wire indicated at 3 electro- (or otherwise) plated with a monomolecular brass layer 4 to increase the adherence of superimposed elastomer layer 5, which preferably consists of synthetic rubber, but may also include natural rubber, or a mixture of synthetic and natural rubber, but may also consist of polypropylene (especially when the brushing operation should also include absorption of liquid material).

Elastomer layer 5 does not only serve to separate the individual steel wires (generally arranged in bundles and in parallel) but also to permit an elastic coupling between the individual wires as well as between the wires and the supporting structure (generally a metal disc supporting the wire bundles in radial positions as disclosed for example in U.S. Patent Specification No. 4,137,594.

Furthermore, not only the elasticity of the elastomer coating but also the distance between wires and supporting structure, in accordance, with one feature of the invention, should be large enough, to permit the wire ends, under control of the weight of the brush structure plus the centrifugal force at the high speed provided in accordance with another feature of the invention, to be bent around and extend peripherally along the surface to be brushed, for a distance preferably at least, of the order of the thickness of the material to be brushed off from that surface which is indicated in FIG. 1 at 6. The direction of brushing is indicated at 7 and the direction of pressure is indicated at 8.

Figure 2:
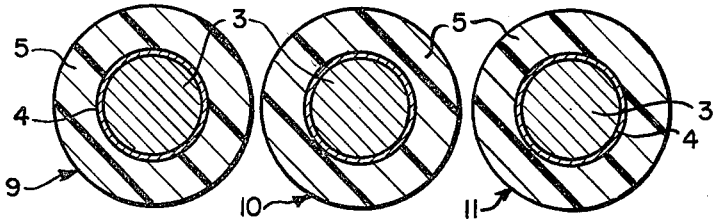
FIG. 2 represents a crosssection through such a wire.

The parallel arrangement of the wire ends is indicated in FIG. 2 by parts 9, 10 and 11 representing wires such as shown in FIG. 1 at an enlarged scale, and in FIG. 2 at a still more enlarged scale.

Figure 4:
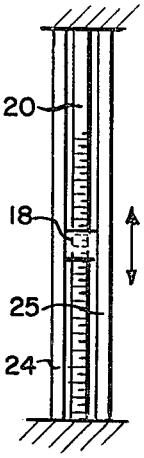
FIGS. 4 and 5 represents side views of FIG. 3.
Figure 3:
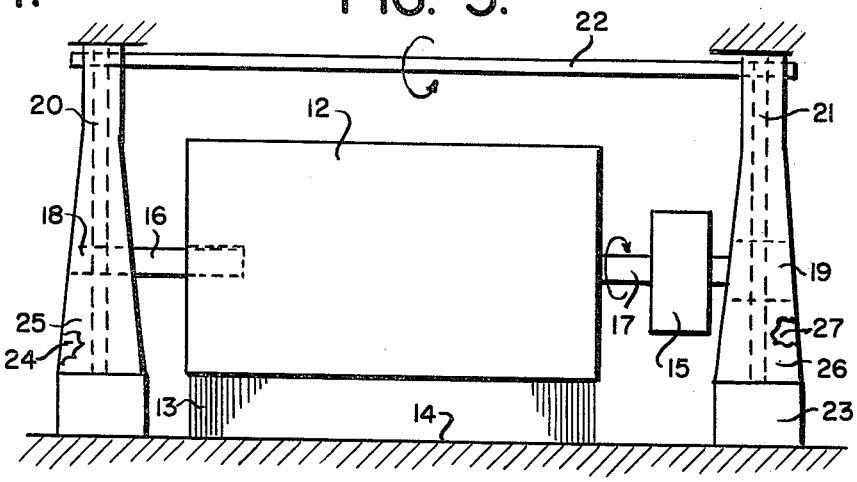
FIG. 3 represents diagrammatically a motor driven cylindrically shaped wire brush equipped to operate at predetermined high speed or speeds with respect to a surface to be treated.
Figure 5:
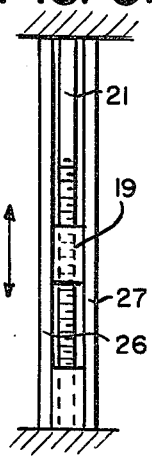

The control of the wires, such as shown in FIG. 1 and 2, is apparent from the assembly schematically indicated in FIGS. 3, 4 and 5, representing a rotary brush 12 which may consist, for example, of a number of discs supporting wires in radial positions with the wire ends extending therefrom. Such wire ends are illustrated in FIG. 3, at 13, in the form of single wires or wire bundles. In accordance with the invention, these wire ends may extend in non-operative position of the brush, toward the surface to be brushed, indicated at 14, without pressing against that surface. In operative position, and in order to cause the wire ends to bend and engage the surface to be brushed over along a predetermined portion of said surface, as apparent from FIG. 1, brush assembly 12 driven by a motor schematically indicated at 15, is supported on two shafts 16, 17, extending into nuts 18, 19 which in turn are mounted on vertical screws schematically indicated at 20, 21, respectively.

By turning the screws 20, 21 interconnected by horizontal screw 22 which through screw 21 is connected to motor 23, nuts 18, 19 which are held between pairs of guide rails, are capable of being moved upward or downward, thus forcing shafts 16 and 17, supported thereon, together with the brush assembly 12, to move upward or downward, thereby exerting more or less pressure through wire ends 13 on the surface to be brushed.

Since in accordance with one of the features of the invention, centrifugal force exerted at relatively high speed, for example of the order of 10,000 rpm, is effective to produce the predetermined deformation of the wire ends; in accordance with another feature of the invention, additional pressure control has been found to produce the necessary fine-tuning which permits to prevent over-heating and to reduce the danger of damage to the brush structure.

In accordance with this embodiment of the invention, the operating position of the rotary wire brush, and thereby the effectivity of the brush-off, is controlled by the speed, and therewith, by the centrifugal force exerted upon the surface to be brushed, as well as by the pressure capable of being varied by the independent positioning of the brush with respect to that surface.

A specific effect of this double control, is the shaping of the wire ends as schematically indicated in FIG. 1.

In this way, the pressure as well as the brush-off, can be optimized with a minimum of heating, but also with a minimum of vibrations of the wires embedded in the elastomer coating, which contributes to reducing the wire vibrations, by exerting a dampening effect thereupon, all this without exceeding the scope of this invention.

The specific arrangement of wires or wire bundles upon a supporting structure, although known per se, from U.S. Pat. No. 4,137,594, is being found particularly (though not exclusively) adapted to the realization of this invention as will be explained in connection with FIG. 6 and 7.

Figure 6:
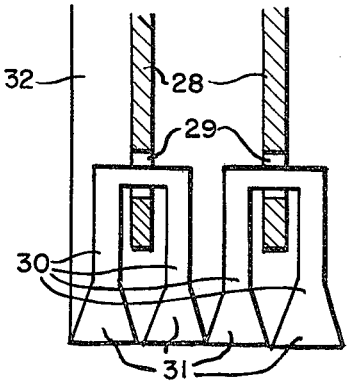
FIG. 6 represents equally in diagrammatical form, the flexible support of the wires within a rotatable brush structure.

FIG. 6 and 7 illustrate in purely schematical form a wire unit of disc shape which can be fitted over a common axis forming a cylindrical structure such as illustrated in FIG. 3 at 12.

In FIG. 6 and 7, a supporting disc is indicated in cross section at 28 (FIG. 6), and in corresponding front view also at 28 in FIG. 7. Disc 28 is provided with a number of openings schematically indicated at 29, which serve as support for wire bundles 30 which in form of loops of any desired shape extend through holes 29 from one side of disc 28 to its other side, extending further radially beyond disc 28, slightly expanding as schematically illustrated in FIG. 6 and 7, at 31.

As apparent from FIG. 6 and 7, the crosssection of the wire bundle is substantially smaller than the crossection of the corresponding supporting hole, to permit the wire bundle under control of the centrifugal force exerted by the entire structure to move radially forward and backward. This movement, in accordance with the invention, will be controlled by the characteristic of the elastomer, which provides a coating for the individual wires of the wire bundle, as well as a coating for the entire disc, or for a number of parallel discs with openings facing each other in linear alignment forming a compact, preferably vulcanized, structure.

In this manner, the resulting structure forms an easily transportable and readily applicable wire brush, comprising internal elements capable of flexible and controllable movements, to produce an optimum of brush-off effect with a minimum of energy.

While the invention has been illustrated and described with a number of drawings, it is not limited thereto, and certainly not limited to schematical designs which have been added to explain the specific internal controls of certain elements of the wire brush characteristic of the invention, but they also serve to illustrate the cooperation of these internal control elements with the external control elements provided in accordance with the invention, and especially the double control characteristic of certain embodiments of this inventions, all these elements and their modifications, forming part of this invention, without departing from the scope of this disclosure.

I claim:

1. In an apparatus for brushing a predetermined surface, a substantially cylindrical wire brush comprising a plurality of parallel disc shaped elements molded into a compact unit and mounted for rotation about an axis, each of said elements comprising a supporting disc having a plurality of openings adjacent the periphery thereof, wire bundles extending through said openings with the ends of said bundles extending radially beyond the periphery of said disc and terminating in wire ends for contacting said surface, said holes being substantially larger than the cross section of said wire bundles supported therein to permit radial movement of said wire bundles relative to said disc, the openings of adjacent discs facing each other in linear alignment to assume simultaneous positioning of the wire ends during their radial movement, each disc being coated with an elastomer material which further coats the wire bundles at least to the periphery of the disc and fills said openings and positions said wire bundles in a central portion of said openings when said brush is in a stationary position, the elastomer coating permitting radial movement of said wire bundles with respect to said disc when said brush is rotated, means for adjusting the position of the axis of said brush, and means for rotating said wire brush to apply pressure under control of said elastomer.

* * * * *